United States Patent [19]

Merz et al.

[11] 4,053,866

[45] Oct. 11, 1977

[54] ELECTRICAL RESISTOR WITH NOVEL TERMINATION AND METHOD OF MAKING SAME

[75] Inventors: Kenneth M. Merz, Gladwyne; Howard E. Shapiro, Philadelphia, both of Pa.

[73] Assignee: TRW Inc., Cleveland, Ohio

[21] Appl. No.: 634,481

[22] Filed: Nov. 24, 1975

[51] Int. Cl.[2] ..... H01C 1/012

[52] U.S. Cl. ..... 338/309; 29/621; 252/512; 252/515; 252/513; 252/516; 252/518; 338/327; 338/328; 427/102; 428/433

[58] Field of Search ..... 338/327, 328, 307, 308, 338/309; 106/47–49; 29/610, 619, 620, 621; 427/101, 102, 126; 428/433; 252/515, 516, 518, 512–513, 520

[56] References Cited

U.S. PATENT DOCUMENTS

| | | | |
|---|---|---|---|
| 3,051,592 | 9/1974 | Woerner | 427/229 |
| 3,620,799 | 11/1971 | Hoelscher | 427/373 |
| 3,649,945 | 3/1972 | Waits | 338/309 |
| 3,661,599 | 5/1972 | Buck et al. | 75/255 |
| 3,729,406 | 4/1973 | Osborne | 204/192 R |
| 3,833,842 | 9/1974 | Cunningham | 357/67 |

OTHER PUBLICATIONS

Fogiel, M., *Modern Microelectronics*, "Conductors", Chapter 4, Section 4.3.1, 1972, pp. 232–234.

*Primary Examiner*—C. L. Albritton
*Attorney, Agent, or Firm*—Jacob Trachtman

[57] ABSTRACT

An electrical resistor and method of making same including a substrate of an electrical insulating material having on a surface thereof a film of a resistance material and a termination film of a conductive material at each end of the resistance film. The resistance film is preferably a layer of a glass having embedded therein conductive particles such as tantalum nitride and tantalum or tungsten carbide and tungsten. The termination film contains either molybdenum, tungsten or a mixture thereof.

24 Claims, 3 Drawing Figures

FIG. 1
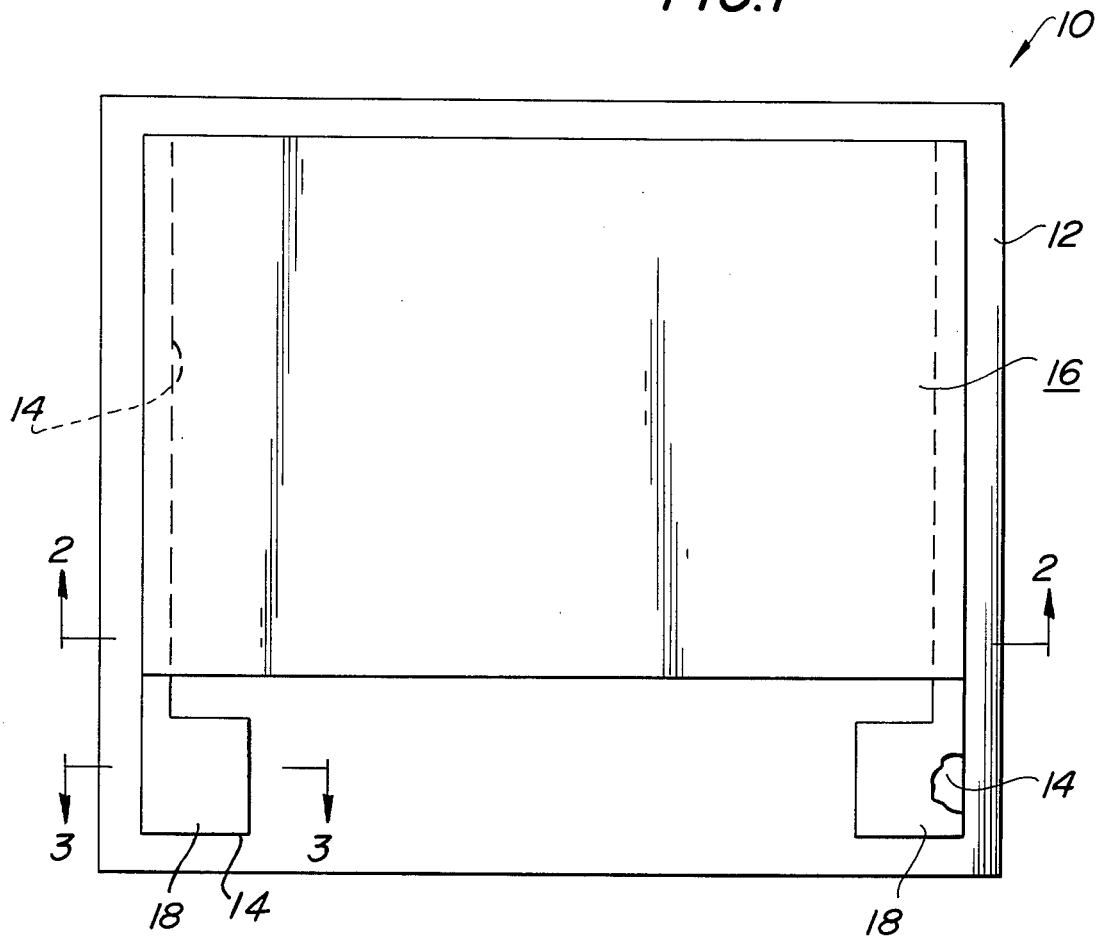
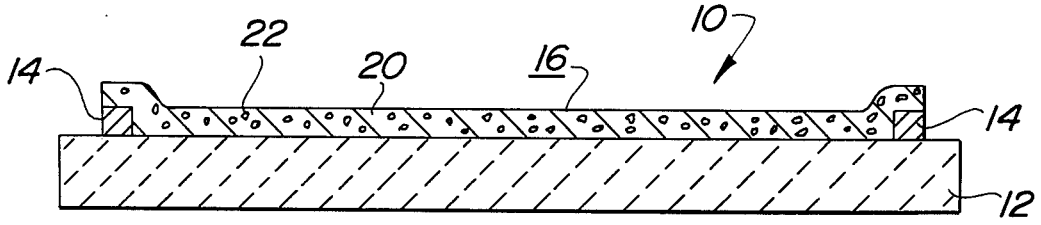
FIG. 2
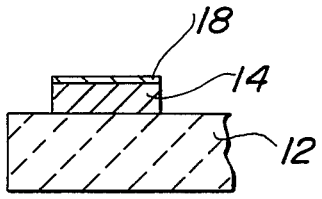
FIG. 3

ELECTRICAL RESISTOR WITH NOVEL TERMINATION AND METHOD OF MAKING SAME

The present invention relates to an electrical resistor having a novel termination and method of making same, and particularly, to a novel termination for vitreous enamel resistors.

A type of resistance material which has come into use is the vitreous enamel resistance material which comprises a mixture of particles of a conductive material and a glass frit. To form a resistor, the vitreous enamel resistance material is applied to a substrate and fired to melt the glass frit. When cooled, the resistor is a layer of glass having the conductive particles dispersed throughout the glass. Initially the conductive particles were of noble metals, such as gold, platinum, silver etc., including mixtures and alloys of such noble metals, to provide a resistor having good electrical characteristics. To reduce the cost of the resistance materials, there was then developed vitreous enamel resistance materials in which non-noble metals were used as the conductive particles. For example, U.S. Pat. No. 3,394,087 to C. Y. D. Huang et al, issued July 23, 1968, entitled "Glass Bonded Resistor Compositions Containing Refractory Metal Nitrides and Refractory Metal" discloses the use of tantalum nitride and tantalum as the conductive particles, and U.S. Pat. No. 3,180,841 to R. M. Murphy et al, issued Apr. 27, 1965 entitled "Resistance Material and Resistor Made Therefrom", discloses the use of tungsten carbide and tungsten as the conductive particles.

In order to make electrical connection to the vitreous enamel resistors, it is desirable to provide the resistor with conductive terminations which are applied to the substrate at the ends of the resistor. Such terminations should be highly conductive and compatible with the particular material of the resistor both chemically, and as to the manner of applying the termination and the resistance material. Good terminations have been achieved with materials containing noble metals. However, these materials are expensive. There are available termination materials based upon copper and nickel. However, these terminations have been found not to be completely compatible with certain vitreous enamel resistance materials, such as those containing tantalum nitride and tantalum as the conductive material. It is therefore desirable to provide a termination material which is inexpensive, is compatible with vitreous enamel resistance materials including tantalum nitride and tantalum and is characterized by extremely high stability.

Therefore, it is an object of the present invention to provide an electrical resistor having a novel termination and method of making same.

It is another object of the present invention to provide a novel termination for a vitreous enamel resistor characterized by extremely high stability.

It is still another object of the present invention to provide a novel termination for a vitreous enamel resistor which termination does not include a noble metal.

It is a further object of the present invention to provide a termination for a vitreous enamel resistor in which the conductive particles of the resistance material are a mixture of either tantalum nitride and tantalum or tungsten carbide and tungsten.

It is a still further object of the present invention to provide a resistor termination which is a film which includes either molybdenum, tungsten or a mixture thereof.

Other objects will appear hereinafter.

The invention accordingly comprises an article of manufacture and method of making same, possessing the features, properties, and the relation of elements which will be exemplified in the article hereinafter described, and the scope of the invention will be indicated in the claims.

For a fuller understanding of the nature and objects of the invention, reference would be had to the following detailed description taken in connection with the accompanying drawing, in which: p FIG. 1 is a top plan view of one form of the resistor of the present invention, FIG. 2 is a sectional view taken along line 2—2 of FIG. 1, and FIG. 3 is a sectional view taken on line 3—3 of FIG. 1.

Referring to the drawing, one form of the electrical resistor of the present invention is generally designated as 10. The resistor 10 comprises a flat substrate 12 of an electrical insulating material. On the surface of the substrate 12 are two spaced terminations 14 of the termination material of the present invention. On the surface of the substrate 12 between the terminations 14 is a resistance material layer 16. The resistance material layer 16 overlaps and contacts a portion of each of the terminations 14. The portions of the terminations 14 not overlapped by the resistance material layer 16 are covered by a contact film 18 of nickel as shown in FIG. 3.

The substrate 12 may be of any electrical insulating material which will withstand the temperatures and conditions for applying the terminations 14 and the resistance material layer 16. The substrate is generally a body of a ceramic material, such as glass, porcelain, steatite, barium titinate, alumina or the like. Although the substrate 12 is shown to be a flat body, it can be of any desired shape, such as tubular, solid cylindrical or the like.

The resistance material layer 16 is preferably a vitreous enamel resistance layer which includes a layer of glass 20 having particles 22 of a conductive material embedded in and dispersed throughout the glass layer. Preferably, the resistance material layer 16 includes as the conductive particles 22 either a mixture of tantalum nitride and tantalum as described in U.S. Pat. No. 3,394,087 or a mixture of tungsten carbide and tungsten as described in U.S. Pat. No. 3,180,841.

The terminations 14 are of a conductive metal selected from tungsten, molybdenum or a mixture thereof. These metals are highly conductive and have been found to be very compatible with the vitreous enamel resistance materials, particularly those containing as the conductive phase a mixture of either tantalum nitride and tantalum, or tungsten carbide and tungsten, so as to provide resistors having good characteristics.

To make a resistor 10, the terminations 14 are first applied to the substrate 12. The terminations 14 are formed from a termination material which is composed of finely divided particles, being less than 20 microns, of the particular metal or mixture of metals, mixed with a suitable vehicle for applying the termination material. The vehicle is preferably an organic medium such as butyl carbitol acetate, pine oil, ethylene cellulose or such commercial mediums as the Reusche screening vehicle. Sufficient vehicle is used to provide a mixture of the desired viscosity for the particular method to be used to apply the termination material to the substrate. The termination material may be applied by dipping, spraying, painting or screen stencil application. To apply a termination of the shape shown in the drawing on a flat substrate, the preferred method of applying the termination material is by screen stencil application. After the termination material is applied to the substrate, it is dried in air preferably at a temperature of about 100° to 150° C to remove the liquid vehicle. The coated substrate is then fired in a furnace at 1525° C or at a temperature between 1450° to 1620° C for about ½ hour. The furnace contains an atmosphere of wet dissociated ammonia ($N_2 + H_2$) having a dew point of −30° ± 20° C. The firing removes the vehicle and bonds the metal termination to the substrate.

To improve the adherence of a molybdenum termination to a ceramic substrate, a small amount 5% to 20%, of either manganese or titanium may be included in the termination material used to make the termination. Although after the termination material is fired, the manganese or titanium is not discernable in the resulting molybdenum termination, the termination does have a better bond strength to the ceramic substrate than if the manganese or titanium was not included in the termination material. It is believed that the manganese or titanium reacts with the ceramic to achieve the better bond strength.

The resistance material layer 16 is then applied to the substrate 12 by any well known technique for applying the particular resistance mixture which is used. For a vitreous enamel resistance material, which is a mixture of a glass frit, conductive particles and a suitable vehicle, the resistance material may be applied by dipping, spraying, painting or screen stencil application. To apply a resistance material layer of the shape shown in the drawing on a flat substrate, the preferred method of applying the resistance material is by screen stencil application. The resistance material layer is then air dried, generally at a temperature of about 100° to 150° C. To insure complete removal of the vehicle, the resistance material layer can then be heated at about 350° C in an inert atmosphere, such as nitrogen. The resistance material layer is then fired at a temperature at which the glass frit becomes molten. The firing temperature wil vary depending on the particular glass frit used and the particular conductive material used. The glass frit generally used is a borosilicate glass. Resistance materials containing such glass frits are generally fired at a temperature between 850° to 1150° C. The resistance material is preferably fired in an inert atmosphere, such as nitrogen.

After the resistance material layer 16 cools, the exposed portions of the terminations 14 are coated with a layer of nickel 18 to permit ease of soldering to the terminations. The nickel coating may be applied by either electroless or electrolytic plating techniques while masking the resistance material layer 16 with a suitable plating resist material. Leads may then be soldered to the terminations 14, and the resistor 10 encapsulated in a suitable protective material.

The following examples are given to illustrate certain preferred details of the invention, it being understood that the details of the examples are not to be taken as in any way limiting the invention thereto.

EXAMPLE I

Resistors were made by applying on the surface of flat alumina substrates a miniature multiplicity of the pattern shown in FIG. 1, to form a plurality of spaced terminations of molybdenum and a resistance material layer between and overlapping the terminations. The resistance material layer was a layer of glass having particles of tantalum nitride and tantalum dispersed throughout the glass. The exposed portions of the terminations were coated with nickel and terminals were soldered to the nickel coated terminations. The resistors were then encapsulated in a plastic material.

The resistors were subjected to various tests to determine the suitability of the resistance material, termination material and the compatibility of the terminations with the resistance material. These tests included a low temperature operation (LTO) test, a moisture test, a short term overload (STOL) test, a temperature cycling test, a load life test, and a heat soak test and are standard tests.

The low temperature operation (LTO) test is to determine the ability of the resistor to operate at low temperatures. This test includes placing the resistors for about 45 minutes in a chamber at about −65° C and applying a working voltage to the resistors. After the voltage is removed, the resistors are slowly brought back to room temperature. The resistance values of the resistors are measured before and after the test to determine any change in resistance.

The moisture test serves to determine the resistance of the component to the deteriorative effects of high humidity and heat conditions. For this test the resistors are subjected to a temperature cycling, while in a high humidity. The resistance of the resistors is measured before and after the test to determine any change in resistance and the appearance of the resistors are checked for any mechanical damage.

The short term overload (STOL) test, is made to determine the stability of the resistance film and the termination. For this test, the resistors are subjected to a voltage of about 2.5 times the rated continuous working voltage for about 5 seconds. The resistance of each of the resistors is measured beore and after the test to determine any change in resistance, and the resistors are visually checked for physical damage.

The temperature cycle test, (also known as thermal shock test), tests the resistance of the component and its elements to exposure at extremes of high and low temperatures and to the shock of alternate exposures to these extremes. This test includes subjecting the resistors to a number of cycles of temperature changes with each cycle including first lowering the temperature to about −55° C, then raising it back to 25° C, then raising it to about 85° C and then lowering it back to 25° C with the resistors being held at each temperature for a specified period of time. The resistance of each of the resistors is measured before and after the test to determine any change in resistance.

The load life test is to determine the effect on the resistors of operating them at an elevated temperature while they are under load for an extended period of time. For this test, the resistors are placed in a chamber at a temperature of about 70° C and a working voltage is intermittently applied to the resistors over an extended period of time. The resistance values of the resistors are measured prior to the test, and at set intervals during the test, to determine changes in resistance.

The heat soak test is to determine the effect on the resistors of subjecting them to an elevated temperature over an extended period of time. For this test the resistors are placed in a chamber at 150° C with no load on the resistors and are retained at the elevated temperature for an extended period of time. The resistance values of the resistors are measured before the test and at set intervals during the test to determine any changes in resistance.

The test results for these resistors are shown in Table I with all results being in percent change in resistance.

Table I

| | Average | Span | |
|---|---|---|---|
| LTO | ±.01 | .01 | −.02 |
| STOL | ±.01 | .05 | −.04 |
| Moisture | ±.02 | .04 | −.02 |
| Temp. Cycling | ±.01 | .02 | −.03 |
| 70° C Load Life | | | |
| 216 hr. | −.03 | .00 | −.05 |
| 504 hr. | −.03 | −.02 | −.05 |
| 1000 hr. | −.01 | .00 | −.04 |
| Heat Soak | | | |
| 96 hr. | ±.03 | .05 | .00 |
| 240 hr. | ±.02 | .07 | −.01 |
| 504 hr. | .03 | .04 | .00 |
| 1000 hr. | .04 | .08 | .00 |

EXAMPLE II

Resistors were made by applying on the surface of flat alumina substrates, a miniature multiplicity of the pattern shown in FIG. 1, to form a plurality of spaced terminations of tungsten. The terminations were applied by screen printing onto the substrates, a mixture of fine particles of tungsten in a vehicle. The terminations were dried in air at a temperature of 100° to 150° C and were then fired at about 1525° C for ½ hour in an atmosphere of wet dissociated ammonia ($N_2 + H_2$). A resistance material layer was then applied to the substrates between and overlapping the terminations. The resistance material layer was applied by screen printing onto the substrates, a mixture of a glass frit and particles of tantalum nitride and tantalum in a vehicle. The resistance material was dried in air at about 100° to 150° C and heated in nitrogen at aout 350° to remove the vehicle. The resistors were then fired in nitrogen to melt the glass. After cooling, a layer of nickel was plated on the exposed portions of the terminations and terminals were soldered to the terminations. The resistors were then encapsulated in a plastic material. The resistors were then subjected to the tests described in Example I. The results of these tests are shown in Table II in percent change in resistance.

Table II

| | Average | Span | |
|---|---|---|---|
| LTO | ±.01 | .02 | −.02 |
| STOL | ±.01 | .02 | −.01 |
| Moisture | .02 | .06 | .00 |
| Temp. Cycling | ±.02 | .07 | −.02 |
| 70° C Load Life | | | |
| 216 hr. | ±.02 | .02 | −.05 |
| 504 hr. | ±.03 | .05 | −.04 |
| 1000 hr. | ±.02 | .15 | −.02 |
| Heat Soak | | | |
| 96 hr. | .02 | .05 | .00 |
| 240 hr. | ±.02 | .08 | −.01 |
| 504 hr. | ±.02 | .10 | −.01 |
| 1000 hr. | .03 | .12 | .00 |

Example III

Resistors were made in the same manner as described in Example II, except that the terminations were made from a termination material which was a mixture, by weight, of 90% molybdenum and 10% titanium. The test results in percent change in resistance for these resistors are shown in Table III.

Table III

| | Average | Span | |
|---|---|---|---|
| LTO | ±.01 | .02 | −.02 |
| STOL | ±.01 | .01 | −.03 |
| Moisture | .02 | .04 | .00 |
| Temp. Cycling | −.01 | .00 | −.03 |
| 70° C Load Life | | | |
| 216 hr. | −.02 | .00 | −.05 |
| 504 hr. | −.02 | .00 | −.05 |
| 1000 hr. | ±.01 | .01 | −.04 |
| Heat Soak | | | |
| 96 hr. | .03 | .06 | .00 |
| 240 hr. | .03 | .10 | .00 |
| 504 hr. | .04 | .08 | .00 |
| 1000 hr. | .08 | .43 | .03 |

EXAMPLE IV

Resistors were made in the same manner as described in Example II, except that the terminations were made of a termination material which was a mixture, by weight, of 80% molybdenum and 20% manganese. The test results in percent change in resistance for these resistors are shown in Table IV.

Table IV

| | Average | Span | |
|---|---|---|---|
| LTO | ±.01 | .03 | −.02 |
| STOL | ±.01 | .02 | −.07 |
| Moisture | .02 | .07 | .00 |
| Temp. Cycling | ±.02 | .01 | −.05 |
| 70° C Load Life | | | |
| 216 hr. | −.03 | −.01 | −.07 |
| 504 hr. | −.04 | −.01 | −.08 |
| 1000 hr. | −.03 | .00 | −.07 |
| Heat Soak | | | |
| 96 hr. | ±.01 | .03 | −.02 |
| 240 hr. | ±.02 | .05 | −.02 |
| 504 hr. | ±.02 | .05 | −.02 |
| 1000 hr. | ±.02 | .06 | −.02 |

EXAMPLE V

Resistors were made in the same manner as described in Example II, except that the terminations were made of a termination material which was, by weight, a mixture of 80% molybdenum and 20% manganese with the addition by weight of less than 5% of the total mixture, of glass frit as a binder. The test results for these resistors are shown in Table V in percent change in resistance.

Table V

| | Average | Span | |
|---|---|---|---|
| LTO | ±.01 | .01 | −.02 |
| STOL | ±.01 | .03 | −.02 |
| Moisture | ±.01 | .03 | −.01 |
| Temp. Cycling | ±.01 | .01 | −.03 |
| 70° C Load Life | | | |
| 216 hr. | −.03 | .00 | −.05 |
| 504 hr. | ±.03 | .01 | −.04 |
| 1000 hr. | ±.03 | .03 | −.04 |
| Heat Soak | | | |
| 96 hr. | ±.01 | .04 | −.01 |
| 240 Hr. | ±.01 | .05 | −.02 |
| 504 hr. | ±.01 | .02 | −.03 |
| 1000 hr. | ±.01 | .05 | −.03 |

EXAMPLE VI

Resistors were made in the same manner as described in Example II, except that the terminations were made of a termination material which was a mixture of, by weight, 75% of molybdenum and 25% tungsten. The test results for these resistors in percent change in resistance are shown in Table VI.

Table VI

| | Average | Span | |
|---|---|---|---|
| LTO | ±.01 | .01 | −.02 |
| STOL | ±.01 | .02 | −.01 |
| Moisture | ±.02 | .04 | −.01 |
| Temp. Cycling | ±.01 | .02 | −.03 |
| 70° C Load Life | | | |
| 216 hr. | −.03 | −.01 | −.05 |
| 504 hr. | −.03 | −.01 | −.05 |
| 1000 hr. | −.02 | .00 | −.04 |
| Heat Soak | | | |
| 96 hr. | ±.01 | .02 | −.02 |
| 240 hr. | ±.01 | .07 | −.03 |
| 504 hr. | ±.01 | .02 | −.03 |
| 1000 hr. | ±.01 | .03 | −.02 |

From the above examples, it can be seen that the resistors made with the terminations of the present invention are very stable, i.e. under the various conditions of the tests, their resistance values changed only a very slight amount. This shows that the terminations of the present inention are stable and compatible with the resistance materials.

EXAMPLE VII

Resistors were made in the same manner as described in Example II, except that the terminations were made of a termination material which was a mixture, by weight, of 80% molybdenum and 20% manganese and the resistance layer material used was a mixtue of glass frit and particles of tungsten carbide and tungsten. The test results for these resistors are shown in Table VII in percent change in resistance.

TABLE VII

| | Average | Span | |
|---|---|---|---|
| LTO | ±.04 | .29 | −.17 |
| STOL | ±.03 | .11 | −.18 |
| Moisture | −.22 | −.03 | −.27 |
| Temp. Cycling | ±.07 | .43 | −.08 |
| 70° C Load Life | | | |
| 1000 hr. | ±.27 | .19 | −.69 |
| 2000 hr. | ±.26 | .14 | −.67 |
| Heat Soak | | | |
| 1000 hr. | ±.61 | 1.45 | −1.47 |
| 2000 hr. | ±.65 | 2.27 | −.99 |

It will thus be seen that the objects set forth above, as well as those made apparent from the preceeding description, are efficiently attained and, since certain changes may be made in the above article without departing from the scope of the invention, it is intended that all matter contained in the above description shall be interpreted as illustrative and not in a limiting sense.

What is claimed is:

1. An electrical resistor comprising a substrate of an electrical insulating material, a termination on and directly adhering to said substrate, said termination being a conductive material selected from the group consisting of molybdenum, tungsten and mixtures of molydenum and tungsten, and a resistance material film on said substrate and contacting the termination.

2. An electrical resistor comprising a substrate of an electrical insulating material, a termination on and directly adhering to said substrate, said termination being a conductive material selected from the group consisting of molybdenum, tungsten and mixtures of molybdenum and tungsten, and a resistance material film on said substrate and contacting the termination, said resistance material film comprising a layer of glass having particles of a conductive material embedded in and dispersed throughout the glass layer.

3. An electrical resistor in accordance with claim 2 in which the conductive particles are a mixture of a refractory metal and a refractory metal nitride.

4. An electrical resistor in accordance with claim 3 in which the conductive particles are a mixture of tantalum nitride and tantalum.

5. An electrical resistor in accordance with claim 2 in which the conductive particles are a mixture of a refractory metal and a refractory metal carbide.

6. An electrical resistor in accordance with claim 5 in which the conductive particles are a mixture of tungsten carbide and tungsten.

7. An electrical resistor in accordance with claim 1 including a pair of spaced terminations on the substrate and in which the resistance material film extends between and overlaps at least a portion of each of the terminations.

8. An electrical resistor comprising a substrate of an electrical insulating material, a termination on said substrate, said termination containing a conductive material selected from the group consisting of molybdenum, tungsten and mixture of molybdenum and tungsten, a resistance material film on said substrate and contacting the termination, p1 the termination including a pair of spaced terminations on the substrate with the resistance material film extending between and overlapping a portion of each of the terminations, and a film of nickel on the portions of the terminations which are not overlapped by the resistance material film.

9. An electrical resistor in accordance with claim 8 in which the resistance material film comprises a layer of glass having particles of a conductive material embedded in and dispersed throughout the glass layer.

10. An electrical resistor in accordance with claim 9 in which the conductive particles are a mixture of tantalum nitride and tantalum.

11. An electrical resistor in accordance with claim 9 in which the conductive particles are a mixture of tungsten carbide and tungsten.

12. An electrical resistor comprising a substrate of an electrical insulating material, a termination on and directly adhering to said substrate, said termination being a fired film of a conductive material selected from the group consisting of molybdenum, tungsten, molybdenum and manganese, and titanium and molybdenum, and a resistance material film on said substrate and contacting said termination.

13. An electrical resistor comprising a substrate of an electrical insulating material, termination on said substrate, said termination being a film of conductive material selected from the group consisting of molybdenum, tungsten, molybdenum and manganese, and titanium and molybdenum, fired at a temperature between 1450° C and 1620° C in a reducing atmosphere, and a resistance material film on said substrate and contacting said termination.

14. An electrical resistor in accordance with claim 13 in which the resistance material film comprises a layer of glass having particles of a conductive material embedded in and dispersed throughout the glass layer.

15. An electrical resistor in accordance with claim 13 in which the conductive particles are a mixture of tantalum nitride and tantalum.

16. An electrical resistor in accordance with claim 14 in which the conductive particles are a mixture of tungsten carbide and tungsten.

17. A method of making an electrical resistor comprising the steps of applying to a substrate of an electrical insulating material over a pair of spaced areas a termination material of particles of a conductive material selected from the group consisting of molybdenum, tungsten, and respective mixtures of molybdenum and tungsten, molybdenum and titanium, and molybdenum and manganese in a vehicle, firing said termination material to form terminations containing the conductive material bonded to the substrate, and applying a resistance material film to said substrate between and contacting said terminations.

18. The method in accordance with claim 17 in which the termination material is fired at a temperature between 1450° and 1620° C in a reducing atmosphere.

19. The method in accordance with claim 18 in which the reducing atmosphere is moist dissociated ammonia and prior to firing the termination material it is dried at a temperature of between 100° and 150° C.

20. The method in accordance with claim 19 in which the resistance material film applied to the substrate is a mixture of a glass frit, particles of a conductive material and a vehicle, and the mixture is fired at a temperature at which the glass melts to form a layer of glass having the conductive particles embedded therein.

21. An electrical resistor made by applying to a substrate of an electrical insulating material over a pair of spaced areas a termination material of particles of a conductive material selected from the group consisting of molybdenum, tungsten, and respective mixtures of molybdenum and tungsten, molybdenum and titanium, and molybdenum and manganese in a vehicle, firing said termination material to form terminations containing the conductive material bonded to the substrate, and applying a resistance material film to said substrate between and contacting said terminations.

22. An electrical resistor made in accordance with claim 21 in which the termination material is fired at a temperature between 1450° and 1620° C in a reducing atmosphere.

23. An electrical resistor made in accordance with claim 22 in which the reducing atmosphere in moist dissociated ammonia and prior to firing the termination material it is dried at a temperature of between 100° and 150° C.

24. An electrical resistor made in accordance with claim 23 in which the resistance material film applied to the substrate is a mixture of a glass frit, particles of a conductive material and a vehicle, and the mixture is fired at a temperature at which the glass melts to form a layer of glass having the conductive particles embedded therein.

* * * * *